United States Patent [19]

Miyai et al.

[11] Patent Number: 4,666,281

[45] Date of Patent: May 19, 1987

[54] IMAGE FORMING APPARATUS

[75] Inventors: Kiyoshi Miyai; Uotani Shuhei; Toyohiko Tsunemine; Yutaka Kamitani; Yuji Nakanishi, all of Hyogo, Japan

[73] Assignee: Sanyo Electric Co., Ltd., Japan

[21] Appl. No.: 733,621

[22] Filed: May 13, 1985

[30] Foreign Application Priority Data

May 16, 1984 [JP] Japan ..... 59-97734

[51] Int. Cl.[4] ..... G03G 15/14; G03G 21/00

[52] U.S. Cl. ..... 355/3 SH; 355/14 SH

[58] Field of Search ..... 355/3 R, 3 SH, 14 R, 355/14 SH

[56] References Cited

U.S. PATENT DOCUMENTS

| | | | |
|---|---|---|---|
| 3,960,446 | 6/1976 | Ogawa et al. | 355/3 R X |
| 4,113,374 | 9/1978 | Nakamura et al. | 355/14 R |
| 4,136,941 | 1/1979 | Sawaoka | 355/3 R |
| 4,392,740 | 7/1983 | Ito et al. | 355/14 SH |

*Primary Examiner*—Fred L. Braun

*Attorney, Agent, or Firm*—Darby & Darby

[57] ABSTRACT

An image forming apparatus includes a photosensitive member on which an electrostatic latent image is formed. The electrostatic latent image is developed by toner and the toner image thus developed is transferred on a copying paper. A stopper is provided in the path of the copying paper to a transferring station. A first paper path for manually feeding paper, and a second paper path is provided for automatically feeding paper. The first and second paths join each other at an upstream side of the stopper. Downstream of the junction of the two paths is formed a common path in which the stopper is disposed. In the common path at the upstream side of the stopper, there is arranged a sensor for sensing the presence of copying paper. In an automatic feeding mode, when a signal is not given from the sensor within a predetermined period of time after a paper feed roller is operated, the occurrence of a jam will be detected. In a manual feeding mode, when an output signal is provided from the sensor indicating that paper is present in the common path, a command for the copy start will be given.

5 Claims, 4 Drawing Figures

IMAGE FORMING APPARATUS

BACKGROUND OF THE INVENTION

1. Field of the Invention

The present invention relates to an image forming apparatus. More specifically, the present invention relates to an image forming apparatus, for example, an electrophotographic copying machine having an automatic paper feeding mechanism from a paper feed cassette and a manual feeding mechanism from a manual feeding section.

2. Description of the Prior Art

An example of a conventional image forming apparatus, such as an electrophotographic copying machine, is disclosed in Japanese Patent Application Laying Open No. 13875/1981 laid open on Oct. 29, 1981. Moreover, a conventional electrophotographic copying machine, for example, is manufactured and sold by Sanyo Electric Co., Ltd. under product number "SFT-850".

In such a conventional electrophotographic copying machine, a detecting switch serving as a jam sensor in an automatic feeding mode was provided in a path to a transferring station from a register roller, and another detecting switch serving as a start switch in a manual feeding mode was disposed in a manual paper feeding path to a register roller. That is, in the prior art electrophotographic copying machine, two separate detecting switches were required for each paper feeding mode. Such a conventional design is disadvantageous in that additional components are required, and the cost and size of the machine are increased.

SUMMARY OF THE INVENTION

Therefore, it is a principal object of the present invention to provide an image forming apparatus having a manual and an automatic feeding mechanism with a small number of components.

It is another object of the present invention to provide an image forming apparatus, wherein the number of detecting switches is reduced.

The present invention is an image forming apparatus comprising a manual paper feeding path and an automatic paper feeding path which join each other to form a common paper feed path and having sensing means for sensing the presence of paper on a downstream side of the junction of the two paths. The sensing means serves as a jam sensor in an automatic feeding mode and operates as a start switch in a manual feeding mode.

According to the present invention, two sensing means required in the conventional image forming apparatus having the manual and automatic feeding mechanisms may be reduced to one. Thus, according to the present invention, the number of components can be reduced, and the image forming apparatus, such as the electrophotographic copying machine may be made smaller and manufactured at a lower cost, compared with conventional image forming devices.

These objects and other objects, features, aspects and advantages of the present invention will become more apparent from the following detailed description of preferred the embodiments of the present invention when taken in connection with the accompanying drawings.

DESCRIPTION OF THE PREFERRED EMBODIMENTS

Figure 1:
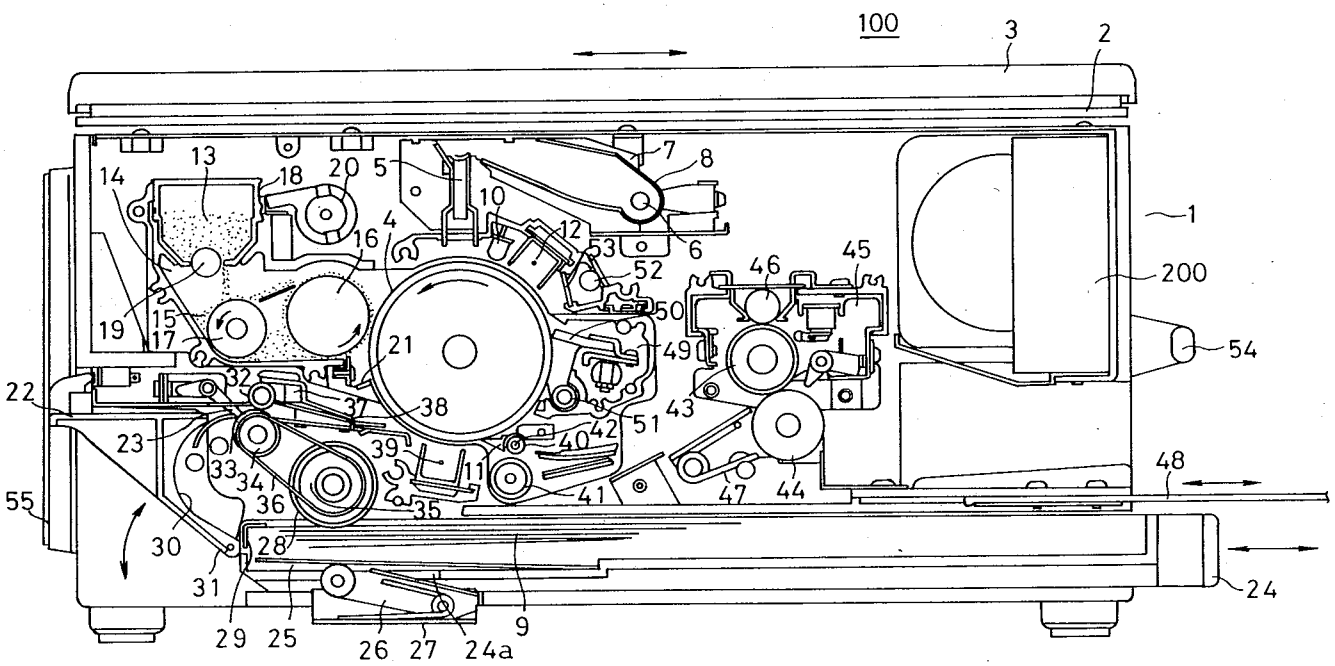
FIG. 1 is an illustrative view showing an internal structure of an embodiment of the present invention.

FIG. 1 is an illustrative view showing an embodiment of the present invention. Meanwhile, before the description of the present invention proceeds, it is to be noted that the present invention may be used in image forming apparatus other than an electrophotographic copying machine, for example, a printer, a facsimile and so on, or further in apparatus other than the type which develops an electrostatic latent image by the toner.

The electrophotographic copying machine 100 includes a body 1, on which upper surface an original table 2 consisting of a transparent glass plate is mounted movably in the direction shown by an arrow. A cover 3 is mounted on the upper surface of the original table 2 in a freely open and close fashion and an original is moved toward the direction of arrow as held therebetween.

In a generally center portion inside of the body 1, a photosensitive drum 4 is provided rotatably in the direction shown by an arrow. The photosensitive drum 4 includes a photoconductive layer coated with a photosensitive material, for example, such as amorphous silicon, polyvinyl carbazole and so on.

Above the photosensitive drum 4, a short focus lens array 5 is arranged in such a way that the optical axis thereof will be directed generally a vertical direction, whereby the image formed by the original placed on the original table 2 is focused on the periphery of the photosensitive drum 4. On the right hand side of the short focus lens array 5, there is provided an exposure lamp 6, for example, such as a halogen lamp, for exposing the surface of the orignal placed on the original table 2. The exposure lamp 6 is fixed onto a common chassis 7 of the short focus lens array 5. Then, a reflector 8 is arranged around the exposure lamp 6, whereby the light therefrom is applied to the surface of the original through a slit (not shown) formed on the upper surface of the body 1.

At an upstream side of the short focus lens array 5 in a rotating direction of the photosensitive drum 4, a side erase lamp 10 is arranged, which erases an electric charge on the portions corresponding to the side edges of the copying paper 9 on the photosensitive drum 4. The erasing of the electric charge on the portion thereof by the side erase lamp 10 is for detaching the copying paper 9 from the photosensitive drum 4 by contacting a separating claw 11 thereto as to be described later. Now, on the further upstream side of the side erase lamp 10, a charging corotron 12 is provided for uniformly charging the photosensitive drum 4.

At a downstream side of he short focus lens array 5 in the rotating direction of the photosensitive drum 4, a developing device 14 for developing the electrostatic latent image formed by the changing corotron 12 and the short focus lens array 5 by toner 13 is arranged. In the developing device 14, a magnet roller 16 for conveying a developer 15 consisting of the mixture of toner and carrier, toward the surface of the photosensitive drum 4 is disposed rotatably. Moreover, the developing device 14 includes a screw roller for mixing toner and carrier by the rotation thereof.

Above the developing device 14, a toner hopper 18 having a sponge roller 19 for supplying the toner 13 contained therein little by little to the developing device 14, on the bottom thereof, is mounted attachably/-detachably. Then, on the bottom of the toner hopper 18, although not shown, a shutter for preventing the leakage of the toner 13 when the toner hopper 13 being removed and carried is provided, which is opened automatically by mounting the toner hopper 18 on the developing device 14.

A counter 20 is disposed associated with the toner hopper 18, which is incremented at each time when the toner hopper 18 being replaced and the counted value thereof indicates the times of replacement of the toner hopper 18. Then, when the counted value of the counter 20 shows, for example, "5", an alarm for informing the replacement of the photosensitive drum 4 will be displayed on an operation panel (not shown) of the body 1. Then, a mechanism for retarding the further replacement of the toner hopper 18 when the counted value of the counter 20 has reached, for example, "5", is provided.

At the downstream end portion of the developing device 14, a magnet 21 for catching the carrier leaked from the developing device 14 is disposed.

On the left end side of the body 1 in FIG. 1, a paper feed table 22 for a manual feeding is provided and a path thereabove serves as the first path for the manual feeding. A sensor 23 is disposed on a downstream side of the paper feed table 22 in the feeding direction. The sensor 23 serves as a start switch in a manual feeding mode and as a jam sensor in an automatic feeding mode as to be described later. Meanwhile, in the embodiment, although the sensor is explained as a mechanical sensor having a claw, it may be a photosensor which detects the presence of paper optically.

On the bottom inside the body 1, a paper feed cassette 24 used in the automatic feeding mode is mounted attachably/detachably. The paper feed cassette 24 is mounted from the right hand side toward the left of the body 1 in FIG. 1. On the bottom inside the paper feed cassette 24, a support plate 25, whereon the copying paper 9 are placed in a stacked manner, is provided. An aperture 24*a* is formed under the support plate 25 and a free end of a push-up lever 26 mounted in a freely swingable state on the bottom of the body 1 at the base end thereof is extending therethrough. On the push-up lever 26, a torsion spring 27 for urging thereof to rotate in a clockwise direction is mounted an the support plate 25 is pushed upwardly thereby.

Above the left end of the paper feed cassette 24, a paper feed roller 28 is arranged for picking up and feeding the copying paper 9 contained in the paper feed cassette 24 one by one. More specifically, the paper feed roller 28 presses the uppermost layer of the copying paper by gravity thereof, while the lowermost layer of the copying paper being pushed up by the push-up lever 26 forced by the torsion spring 27, and when the paper feed roller 28 is rotated in this state, the uppermost layer of the copying paper contacting the periphery thereof will be picked up. On the upper left end of the paper feed cassette 24, a corner separator 29 for separating the copying paper 9 sheet by sheet is provided.

Above the left side of the paper feed cassette 24, a guide 30 for turning the copying paper 9 picked up by the paper feed roller 28 upwardly in U-turn is disposed. The guide 30 serves as the second path for the automatic feeding. The guide 30 is formed integrally with the manual paper feed table 22 and constituted so as to be rotatable in an anti-clockwise direction about the support axis 31 extending through the lower end thereof.

At the downstream side of the guide 30 in the paper feeding direction, a pair of conveying rollers 32 and 33 are provided. The copying paper 9 fed from the paper feed cassette 24 or the paper feed table 22 through the pair of conveying rollers 32 and 33 is conveyed again toward the direction of the photosensitive drum 4, synchronizing with the operation of the original table 2 after being stopped temporarily by a stopper 38 to be described later. The lower roller 33 of the pair of conveying rollers 32 and 33 is coupled to a driving source, therefore, it is rotating continuously. Then, the lower roller 33 and the paper feed roller 28 are connected via pulleys 34 and 35 and a belt 36, and a clutch (not shown) is provided between the paper feed roller 28 and the pulley 35. The clutch connects the paper feed roller 28 to the roller 33, namely, the driving source, when it is operated in the automatic feeding mode.

The upper roller 32 of the pair of conveying rollers 32 and 32 is mounted rotatably on one end of the stopper 38 which is secured to a retaining shaft 37 provided rotatably on the body 1. An opposite end of the stopper 38 is bent in an L-shape, whereby the end edge on the downstream side, that is, the front edge of the copying paper 9 being fed from the paper feed cassette 24 or the paper feed table 22 is restrained. The left and right moments of the stopper 38 are balanced at the retaining shaft 37 as the center before the copying paper 9 reaches theat, accordingly the pair of conveying rollers 32 and 33 are slightly contacting each other. Therefore, in this state, even when the lower roller 33 is rotating continuously the upper roller 32 stays stationary and the copying paper 9 will be not conveyed toward the downstream just by reaching between the conveying rollers 32 and 33.

Thereafter, when the front edge of the copying paper 9 fed from the paper feed table 22 or the paper feed cassette 24 is restrained by the L-shaped portion of the stopper 38, an anti-clockwise moment at the retaining shaft 37 as the center is provided to the stopper 38, thus allowing the conveying rollers 32 and 33 to contact each other. Accordingly, the copying paper 9 arrived is held between the conveying rollers 32 and 33. However, in this state, a feeding force required to pass under the stopper 38 is still not provided to the copying paper 9. Accordingly, the copying paper 9 continues to stop as the end edge on the downstream side, that is, the front edge thereof being contacted by the L-shaped portion of the stopper 38.

When the predetermined timing associated with the operation of the original table 2 arrives, the clutch (not shown) mounted on the stopper 38 is operated and an anti-clockwise moment is applied further to the stopper 38. The copying paper 9 is, therefore, held tightly between the conveying rollers 32 and 33, thereby a stronger feeding force is provided to the copying paper 9 and simultaneously the stopper 39 opens the path thereof. Then, the copying paper 9 is sent toward the photosensitive drum 4, that is, a transferring station after barely passing through the L-shaped portion of the stopper 38.

Meanwhile, register means such as a general register roller may be used in place of the combination of the conveying rollers and the stopper described above.

Under the photosensitive drum 4, a transferring corotron 39 for transferring a toner image developed by the developing device 14 on the copying paper 9 being fed in a manner described above is disposed. On the downstream side of the transferring corotron 39, the separating claw 11 for detaching the copying paper 9 from the photosensitive drum 4 is arranged. The separating claw 11 is mounted rotatably on a supporting axis 42 of an upper roller 40 of a pair of conveying rollers 40 and 41, and is inclined normally toward the surface of the photosensitive drum 4 by a spring (not shown).

On the further downstream side of the conveying rollers 40 and 41 in the conveying direction of the copying paper 9, a fixing device 45 constituted by a heat roller 43 having a heating halogen lamp extending therethrough and a press roller 44 contacting with the heat roller is disposed. Above the heat roller 43, an oil feed pipe 46 for feeding silicone oil to the heat roller 43 is contacting slightly thereto. The oil feed pipe 46 is filled with silicone oil and the wall thereof is formed in porous. Accordingly, the silicone oil in the oil feed pipe 46 is fed slowly onto the heat roller 43 penetrating through the wall of the pipe 46. In addition, on the left hand side of the press roller 44, a torsion spring 47 for pressing the press roller 44 toward the heat roller 43 is provided.

The copying paper 9 having the toner image being fixed by the fixing device 45 is discharged on a copy receiving tray 48 disposed above the paper feed tray 24. In the meantime, the copy receiving tray 48 is retractable to the body 1 and retracted thereinto when not in use.

At the downstream side of the separating claw 11 along the rotating direction of the photosensitive drum 4, a cleaning device 49 for removing the toner remained on the photosensitive drum 4 without being transferred on the copying paper 9 is provided. The cleaning device 49 includes a blade 50 made of rubber for scraping the residual toner on the photosensitive drum 4 and a screw conveyor 51 for discharging the toner scraped off by the blade 50. On the blade 50, also a spring (not shown) for forcibly directing the edge thereof toward the photosensitive drum 4 is disposed. Then, on the further downstream side of the cleaning device 49, an eraser lamp 52 for removing the all residual charge on the photosensitive drum 4 is provided. In front of the eraser lamp 49, a filter 53 is arranged.

At the right hand side of the body 1, a handle 54 for lifting the body 1 is provided and on the opposite side thereof, a rubber cushion 55 of a square column shape is disposed. The rubber cushion 55 serves for protecting the body 1 when it is lifted by the handle 54 and placed in that state.

Inside the body 1, there is further provided a control box 200 for housing a control circuit as to be described later.

Figure 2:
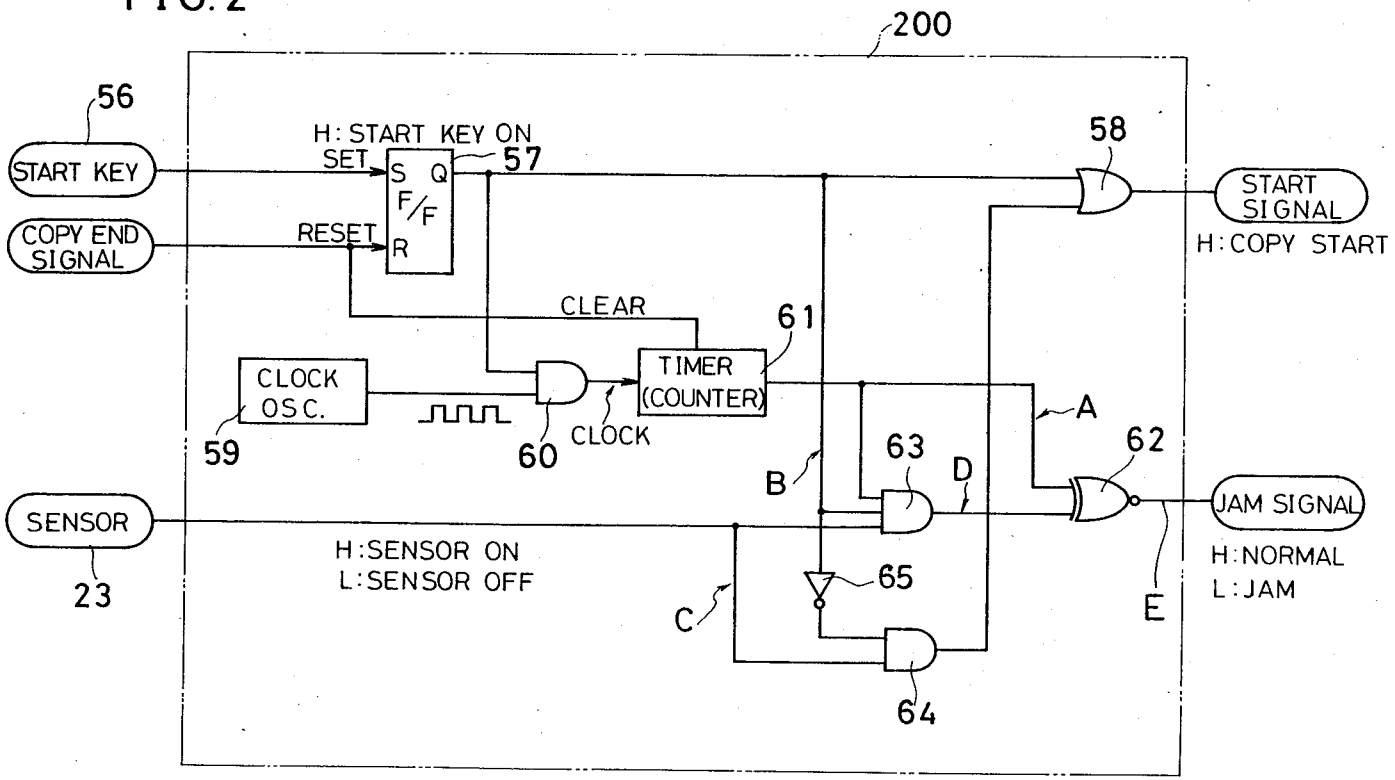
FIG. 2 is a circuit diagram showing a major portion of an example of a control circuit.

FIG. 2 is a circuit diagram showing an example of a control circuit. Referring to FIG. 2, a copy start key 56 is provided on an operation panel (not shown) and a signal therefrom is given to a set input of a flip-flop 57 contained in the control circuit. A copy end signal generated from a sensor (not shown) when the copied paper is discharged on the copy receiving tray 48 (FIG. 1) is given to a reset input of the flip-flop 57.

The output of the flip-flop 57, namely, the signal B is given to one input of an OR gate 58 as well as to one input of an AND gate 60 which receives a clock signal from a clock generator 59 at the other input. The output of the AND gate 60 is given as a count input of a timer 61 constituted by a counter and the copy end signal is provided as a clear signal thereof to the timer 61.

The output of the timer 61, namely, the signal A is in a low level during the operation thereof and changed to a high level at the time up. The signal A from the timer 61 is given to one input of an exclusive NOR gate 62 as well as to one input of a three input AND gate 63. To another input of the AND gate 63, the output of the flip-flop 57 is given and to the remaining input, the output from the sensor 23, namely, the signal C is provided. The signal from the sensor 23 is further given to one input of and AND gate 64 and to the other input thereof, the output of the flip-flop 57, namely, the signal B inverted by an inverter 65 is given. The output of the AND gate 63 mentioned above, namely, the signal D is given as the other input of the exclusive NOR gate 62 and the output of the AND gate 64 is given as the other input of the OR gate 58.

The high level signal from the OR gate 58 is given to a copy mechanism (not shown) as the copy start signal. Then, the low level output from the exclusive NOR gate 62, namely, the signal E is a jam signal, and the fact that the jam has occurred is displayed, for example, on the operation panel (not shown).

In the automatic feeding mode, when the start key 56 (FIG. 2) is pressed after mounting the cassette 24 and placing the original on the original table 2, the flip-flop 57 included in the control circuit will be set and the output thereof, namely, the signal B will become high level. Accordingly, the high level start signal will be provided from the OR gate 58. According to the start signal, the copying mechanism (not shown) is operated and the original table 2 is temporarily moved rightward and then returned leftward. During the return movement, the light image of the original formed by the exposure lamp 6 is focused on the photosensitive drum 4 through the short focus lens array 5. Accordingly, the electrostatic latent image corresponding to the original image is formed on the photosensitive drum 4 and developed by the toner by the developing device 14.

On the other hand, the clock signal from the clock generator 59 is given to the timer 61 through the AND gate 60 opened by the signal B from the flip-flops 57. In addition, the copying paper 9 picked up from the paper feed cassette 24 by the paper feed roller 28 is fed to the guide 30 and to the pair of conveying rollers 32 and 33 therethrough. At this time, when the sensor 23 detects the presence of the copying paper 9 being fed, the high level signal C is obtained from the sensor 23. While, the timer 61 is still not cleared, accordingly three inputs of the AND gate 63 become high level and thus the signal D therefrom becomes the high level. Now, the output of the timer 61, namely, the signal A is in the low level, accordingly the output from the exclusive NOR gate 62, namely, the signal E become high level and the normal state without the jam will be confirmed.

Assuming the copying paper 9 picked up from the paper feed roller 28 is jammed in the guide 30, the output of the sensor 23 stays in the low level in this state. Accordingly, the signal D from the AND gate 63 remains in the low level till the timer 61 is counted up. Then, since the signal C from the sensor 23 remains in the low level even after the count up of the timer 61, the two inputs of the exclusive NOR gate 62 become low level, accordingly the signal E therefrom remains in the low level. The low level output from the exclusive NOR gate 62 is given to the copying mechanism as the jam signal in the automatic feeding mode. Accordingly, in this state, the characters indicating the jam is displayed, for example, on the operation panel.

In the manual feeding mode, when the copying paper is fed from the paper feed table 22, the front edge thereof is detected by the sensor 23. Accordingly, the signal C from the sensor 23 is in the high level. On the other hand, in the manual feeding mode, since the copy start key is not pressed, the output of the flip-flop 57, namely, the signal B remains in the low level. Accordingly, the two inputs of the AND gate 64 become high level and the output therefrom is led out from the OR gate 58 as the high level signal. The high level signal from the OR gate 58 serves as the copy start signal as previously described and the normal copying is performed thereafter.

Then, in the manual feeding mode, since the input from the flip flop 57 to be given to the AND gate 63 remains in the low level, the signal E from the exclusive NOR gate 62 becomes high level after the elapse of the predetermined time by the timer 61. That is, the normal operation will be confirmed by the high level output of the exclusive NOR gate 62.

In such a manner, the sensor 23 disposed at the junction of the first path of the copying paper from the manual paper feed table 22 and the second path of the copying paper from the paper feed cassette 24 or at the downstream side therefrom functions respectively as the jam sensor in the automatic feeding mode and as the copy start switch in the manual feeding mode. Accordingly, either of the sensors disposed separately in the respective path as in the past may be omitted.

Such operation of the circuit in FIG. 2 will be shown in the following table,

TABLE

| Mode | Signals A | B | C | D | E | Operations |
|---|---|---|---|---|---|---|
| Automatic Feeding | H | H | H | H | H | Normal |
| | H | H | L | L | L | JAM |
| | L | H | H | L | H | Paper arrive (Normal) |
| | L | H | L | L | H | Timer in Operation |
| Manual Feeding | H | L | H | L | L | The combinations of A, B, C |
| | H | L | L | L | L | inputs in this state do not exist. |
| | L | L | H | L | H | Start manually (Normal) |
| | L | L | L | L | H | Copying not started |

Figure 3:
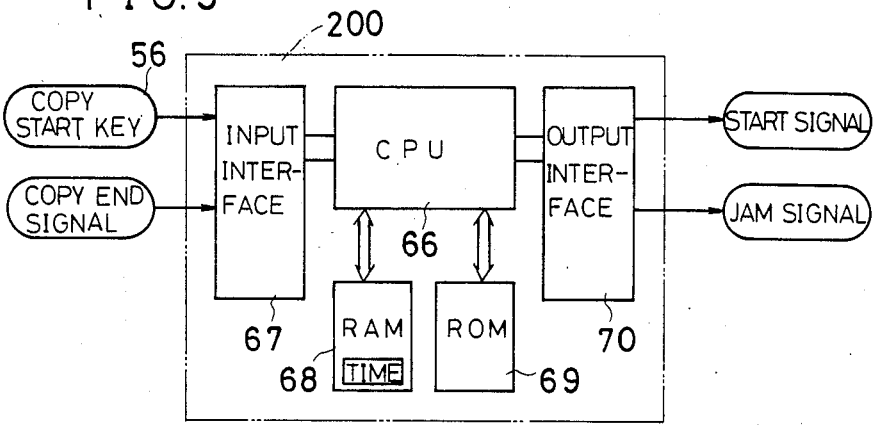
FIG. 3 is a block diagram showing another example of a control circuit.

FIG. 3 is a block diagram showing another example of the control circuit. The control circuit includes a CPU 66, to which the copy end signal and the signal from the start key 56 is given through an input interface 67. A RAM 68 for storing the data for the control temporarily and a ROM 69 for storing the control program to be described later are connected to the CPU 66. Then, from the CPU 66, the start signal and the jam signal are provided through an output interface 70 as same as the circuit in FIG. 2.

Figure 4:
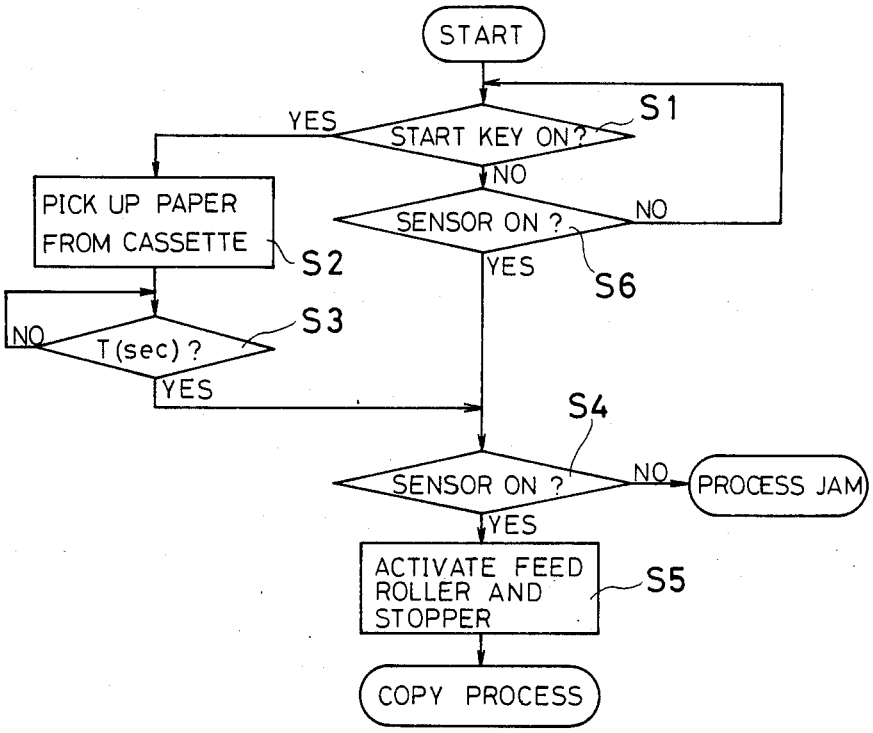
FIG. 4 is a flow diagram for explaining the operation of the circuit shown in FIG. 3.

Referring to FIG. 4, at the first step S1, the CPU 66 determines whether or not the signal from the start key is present. Then, if the signal from the start key is present, the CPU 66 gives the signal to the clutch (not shown) at the next step S2. Accordingly, the clutch is operated and the copying paper 9 from the paper feed cassette 24 is picked up by the paper feed roller 28. Thereafter, when the elapse of the predetermined time (corresonding to the time of the timer 61 in FIG. 2) is detected at step S3, the CPU 66 determines whether the sensor 23 is on or not at the next step S4. When the sensor 23 is not on after the predetermined time has elapsed at the step S3, the CPU 66 provides the jam signal through the output interface 70 for showing the fact that the copying paper 9 supplied from the feed paper cassette 24 is jammed inside the guide 30 (FIG. 1), accordingly, the copying mechanism executes the jam process.

On the other hand, when the sensor 23 is on, that is, if the copying paper 9 is present in the position of the sensor 23 after the elapse of the predetermined time at the step S3, the CPU 66 gives the signal to the clutch (not shown) at the next step S5 as the normal operation being performed. Accordingly, the clutch is operated thus allowing the pair of conveying rollers 32 and 33 to operate and as previously described, the copying paper being fed is conveyed toward the photosensitive drum 4, whereby the normal copying will be continued.

When the press of the start key is not detected at the first step S1, the CPU 66 further executes the step S6. Then, when the sensor 23 is put on at the step S6, that is, when the copying paper 9 is fed from the manual paper feed table 22, the CPU 66 at the next step S5, operates the pair of conveying rollers and the stopper so as to convey the copying paper 9 fed manually to the photosensitive drum 4 by the pair of conveying rollers 32 and 33.

In such a manner, in the embodiments in FIGS. 3 and 4, the sensor 23 is commonly used as the jam sensor in the automatic feeding mode and the start switch in the manual feeding mode.

Although the present invention has been described and illustrated in detail, it is clearly understood that the same is by way of illustration and example only and is not to taken by way of limitation, the spirit and scope of the present invention being limited only by the terms of the appended claims.

What is claimed is:

1. An image forming apparatus adapted to form an image on paper, the apparatus being operable in a manual paper feed mode and in an automatic paper feed mode, the apparatus comprising:

image forming means for forming an image on paper;

manual paper feed path defining means for defining a path for the passage of paper fed manually into the apparatus;

automatic paper feed path defining means for defining a path for the passage of paper fed automatically into the apparatus, the manual paper feed path defining means and the automatic paper feed path defining means converging to join each other at a common junction point in their respective paths;

common paper feed path defining means for defining a common path for the passage of paper fed manually and automatically into the apparatus, the common paper feed path defining means being interposed between the common junction point and the image forming means;

sensing means disposed in the common paper feed path for sensing the presence and absence of paper within the common paper feed path, the sensing means providing an output signal indicative of the presence or absence of paper within the common paper feed path;

means for generating a copy start signal, the copy start signal generating means being activated when the apparatus is operated in the manual paper feed mode, and being responsive to the output signal of the sensing means; and means for generating a paper feed jam signal, the paper feed jam signal generating means being activated when the apparatus is operated in the automatic paper feed mode, and being responsive to the output signal of the sensing means.

2. An image forming apparatus in accordance with claim 1, wherein said copy start signal generating means generates a start signal when paper is sensed to be present within the common paper feed path by said sensing means.

3. An image forming apparatus in accordance with claim 1, which further comprises automatic paper feeding means for automatically feeding paper to said automatic paper feed path defining means; and wherein said paper feed jam signal generating means includes timer means for generating a predetermined time interval after said automatic paper feeding means has been operated, said paper feed jam signal generating means providing said jam signal when said sensing means senses the absence of paper within the common paper feed path after the elapse of the predetermined time interval.

4. An image forming apparatus in accordance with claim 3, wherein said automatic feeding means includes a user operable start key, and paper pick-up means which operates in response to the operation of said start key.

5. An image forming apparatus in accordance with claim 1, which further comprises register means arranged in said common paper feed path and interposed between the sensing means and the image forming means.

* * * * *